US005820044A

United States Patent [19]

Greco

[11] Patent Number: 5,820,044

[45] Date of Patent: Oct. 13, 1998

[54] SOLID MATERIAL PULVERIZER

[76] Inventor: Guido Greco, 22 Tanager La., Northport, N.Y. 11768

[21] Appl. No.: 846,050

[22] Filed: Apr. 25, 1997

[51] Int. Cl.[6] ..... B02C 13/30

[52] U.S. Cl. ..... 241/154; 241/275

[58] Field of Search ..... 384/905, 125, 384/215, 226, 428; 241/154, 275, 101.2

[56] References Cited

U.S. PATENT DOCUMENTS 1,876,416 9/1932 Hill ..... 241/154
2,700,511 1/1955 Denovan et al. ..... 241/154
4,493,459 1/1985 Burkett ..... 241/154
4,886,216 12/1989 Goble .
5,188,302 2/1993 Alvarez ..... 241/154

*Primary Examiner*—Mark Rosenbaum
*Attorney, Agent, or Firm*—Eugene Stephens & Associates

[57] ABSTRACT

A solid material pulverizer using a vertical shaft has a plurality of bearings above a lower fixed bearing that are resiliently held in fixed mounts allowing the bearings to rise vertically against spring pressure as the shaft lengthens from thermal expansion. Impellers fixed to the shaft between the bearings hurl solid material against rings arranged around the impellers, and the rings have multi-sided interiors with ridges and grooves confronting the impeller and angled inward from bottom to top of each ring.

22 Claims, 8 Drawing Sheets

SOLID MATERIAL PULVERIZER

TECHNICAL FIELD

Pulverizers of dry solid material using impellers surrounded by confronting surfaces.

BACKGROUND

Solid material pulverizers such as suggested in Goble U.S. Pat. No. 4,886,216 use stages of impellers surrounded by multi-sided walls against which the impellers fling solid material to be broken into finer particles. The pulverizer of the '216 patent was designed for pulverizing rock fragments, but other solid materials can also be pulverized in such machines.

Through experimentation with solid material pulverizers such as suggested in the '216 patent, I have discovered shortcomings and have made improvements that are explained in this application. My goal has been a pulverizer that operates reliably for extended periods with low maintenance and efficiently pulverizes a variety of solid materials. These goals are realized in the improvements explained and claimed in this application.

SUMMARY OF THE INVENTION

My improvements in a solid material pulverizer involve an improved bearing system for the shaft that drives impellers in a processing chamber, combined with enhanced flowthrough of material being pulverized as it passes through successive stages of the processing chamber. A plurality of bearings above a bottom bearing for a vertical impeller shaft are retained in fixed mounts that allow vertical bearing movement as the shaft elongates from thermal expansion. The mounts have spring systems arranged for pressing resiliently downward against outer races of the bearings, which have sliding fits within the mounts so that they can follow movement of inner races of the bearings, which move with thermal changes in shaft length. The pulverization and flowthrough enhancements involve a ring above an uppermost impeller having multi-faceted surfaces angled downwardly and outwardly to direct material downward into an uppermost impeller. Multi-sided rings around each impeller are angled inward from bottom to top to direct material downward into successive impellers and enhance material flowthrough. The multi-sided surfaces of the rings around the impellers are also configured with ridges and grooves that enhance the pulverizing process.

DRAWINGS

DETAILED DESCRIPTION

Figure 1:
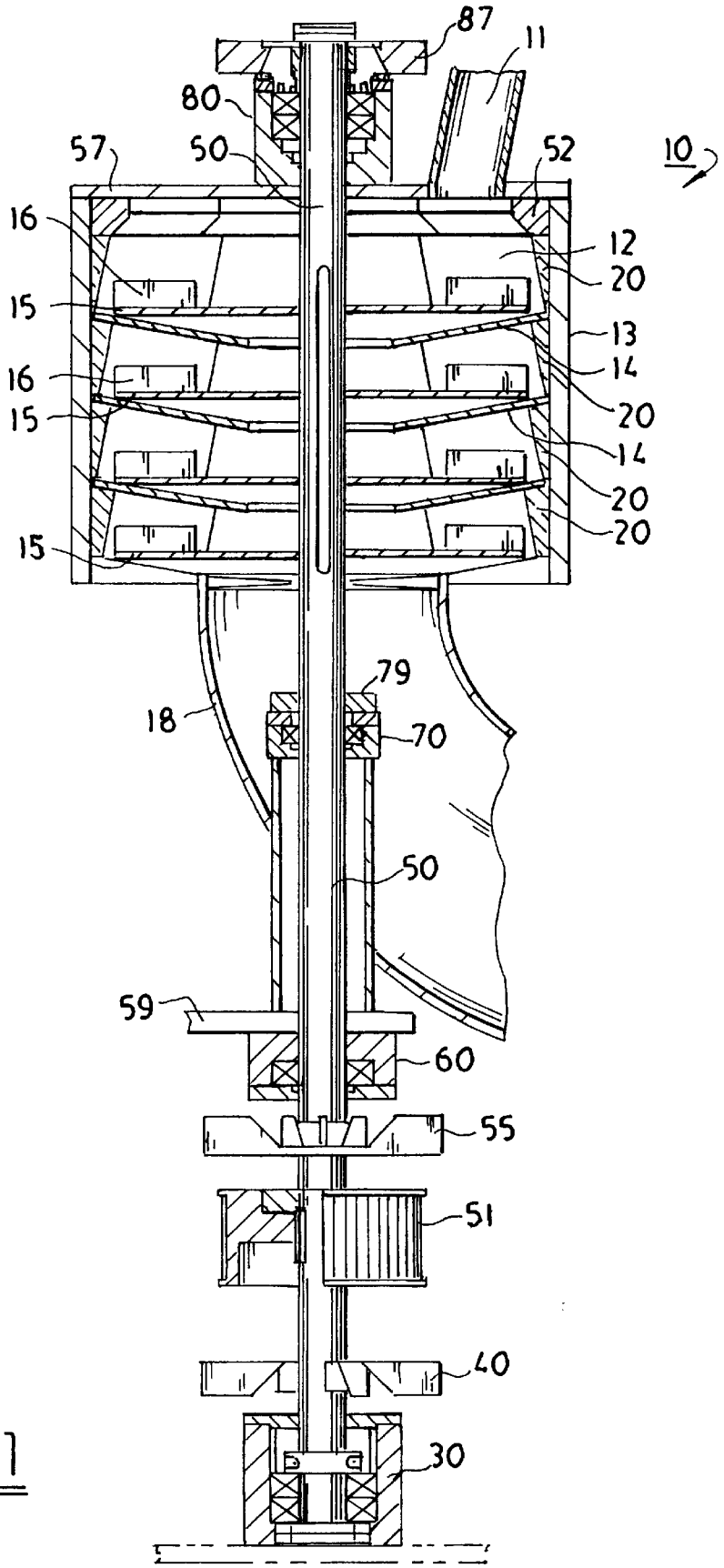
FIG. 1 is a partially schematic and partially cut-away elevational view of a preferred embodiment of a solid material pulverizer improved according to my invention.

My improvements apply to a solid material pulverizer 10 schematically illustrated in FIG. 1. Solid material to be pulverized enters an inlet 11 to a processing chamber 12 within container 13. Chamber 12 is divided into four compartments by baffle plates 14, and each compartment contains a rotor 15. Rotors 15 are fixed to shaft 50 for rapid rotation within processing chamber 12.

Each rotor 15 has peripheral vanes 16 that impel solid material radially outward against inside surfaces of rings 20 that are arranged around each impeller 15. Rings 20 preferably have multi-sided internal surfaces surrounding and confronting each respective impeller 15. Solid material flung radially outward by vanes 16 on rotors 15 impacts against the internal surfaces of rings 20 for breaking the solid material down into finer particles.

As the particles become smaller, they move downward through successive stages within processing chamber 12. The particles pass through spaces that are available between vanes 16 of impellers 15 and the inside surfaces of rings 20. The material then flows through central openings of successive baffle plates 14 to enter lower stages where it encounters successive impellers 15.

The pulverized material outlet from the lowermost stage below the lowermost impeller 15 proceeds downward through an output chute 18. The rotation of vanes 16 on impellers 15 pumps air through processing chamber 12 along with solid material, and this helps force pulverized particles through output chute 18, along with an air stream.

Some of my improvements involve structures within processing chamber 12, and other improvements involve a bearing support system for shaft 50. The bearing support system will be explained first.

Considerable power is input to shaft 50 via pulley 51, for violently hurling solid material outward against rings 20. In a working prototype, for example, a 300 horsepower motor drives shaft 50 by a toothed belt (not shown) mating with teeth on pulley 51. The power expended in processing chamber 12 produces considerable heat, and I have discovered through calculation and experimentation that shaft 50 lengthens about 3 mm from the heat generated during operation. The exact lengthening of shaft 50 will depend on materials used in construction, materials being processed, power input, and other variables; but however much shaft lengthening actually occurs must be accommodated by a bearing system supporting shaft 50. I have devised a bearing system that accomplishes this simply and effectively.

Figure 2:
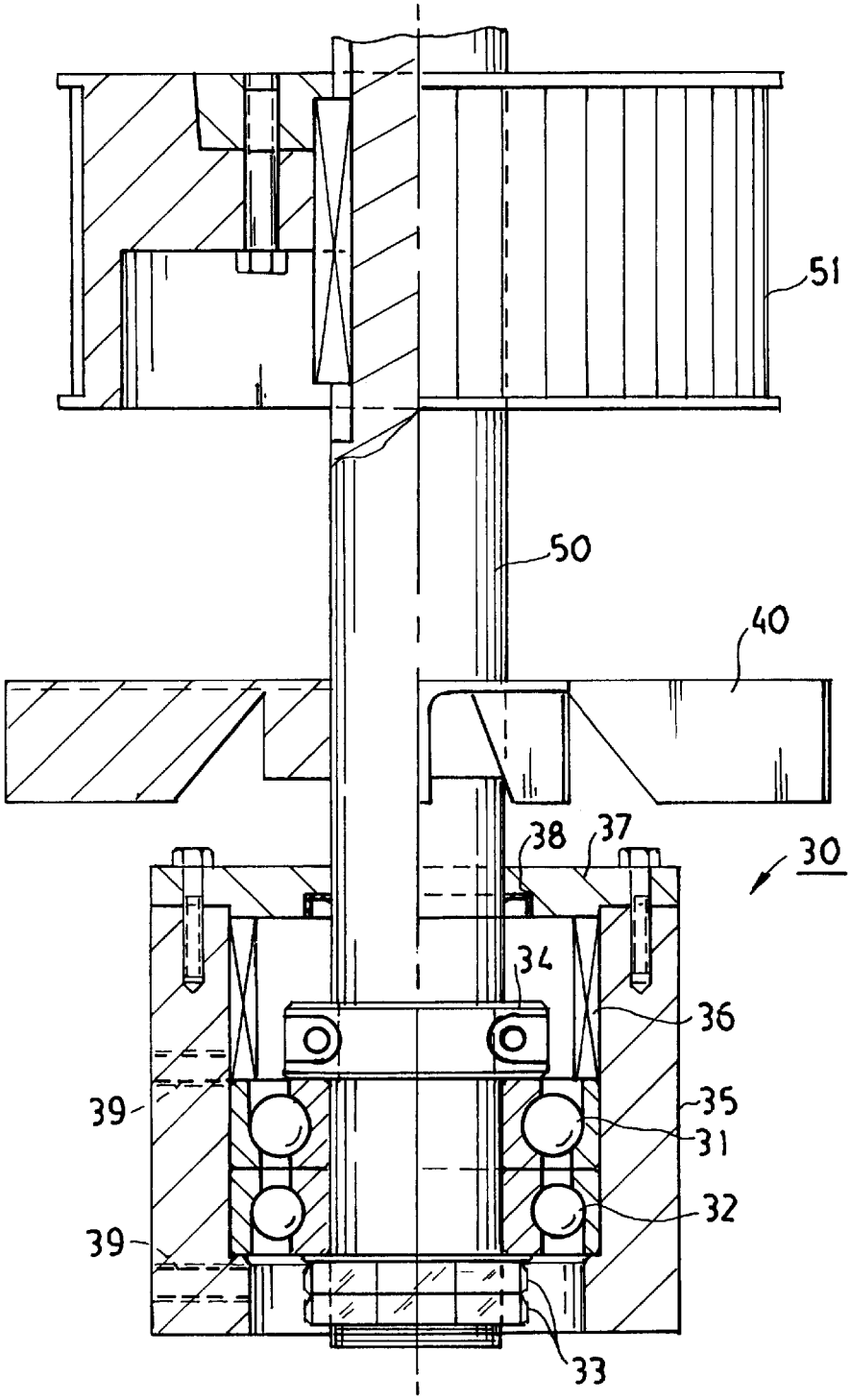
FIG. 2 is an enlarged, partially schematic and partially cut-away elevational view of a bottom bearing assembly for the pulverizer of FIG. 1.

Beginning at the bottom, shaft 50 is supported by bottom bearing 30, as best shown in FIG. 2. A pair of ball bearings 31 and 32 are fitted to a lower region of shaft 50 between bottom collars 33 and a top collar 34. Ball bearings 31 and 32 are arranged in a housing 35 so that outer bearing races fit within the inside of housing 35 and inner bearing races fit on and rotate with shaft 50. A spacer 36 extends between an outer race of bearing 31 and a cover plate 37 that is secured to housing 35. Cover plate 37 contains a seal 38 bearing against shaft 50 to keep dirt out of the inside of housing 35. Bore holes 39 in housing 35 form passageways to admit lubricating grease and provide pressure relief overflow.

A fan 40 is secured to shaft 50 above bearing housing 35 to direct cooling air flow over housing 35 and cover plate 37, for removing heat from ball bearings 31 and 32 during operation. Above fan 40 is pulley 51, which is preferably keyed to shaft 50 for transmitting driving torque from a motor-driven belt (not shown). Shaft 50 has support bearings both above and below pulley 51.

Figure 3:
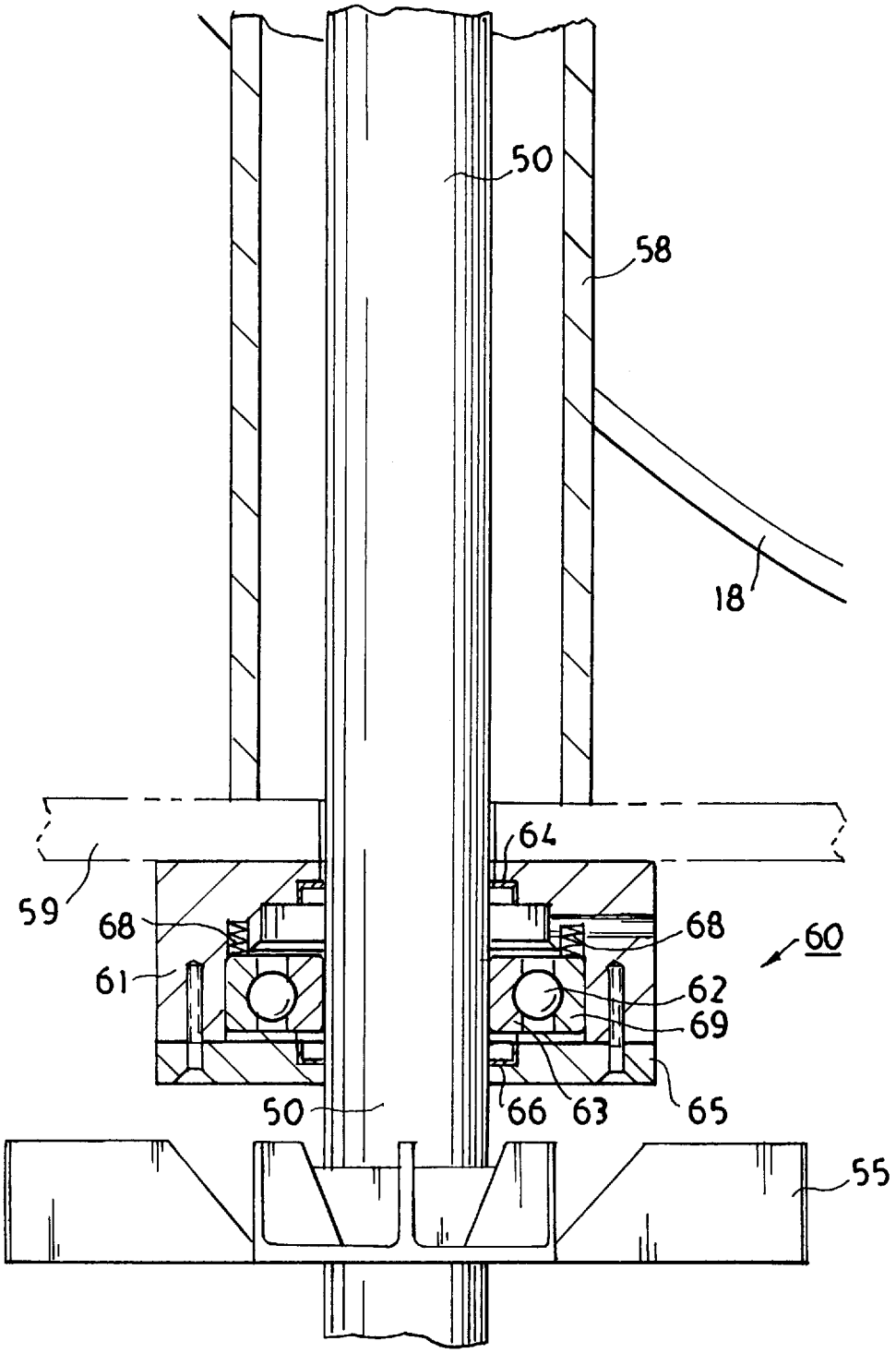
FIG. 3 is an enlarged, partially schematic and partially cut-away bearing assembly arranged below a discharge chute for the pulverizer of FIG. 1.

Above pulley 51 and below discharge chute 18 is a bearing 60 that is best shown in FIG. 3. A fixed support plate 59 holds a bearing mount housing 61 in a fixed position surrounding shaft 50. Within housing 61 is a ball bearing 62 having an inner race 63 fitted on and movable with shaft 50 and an outer race 69 that has a sliding fit allowing vertical movement within mount 61. A seal 64 is arranged between housing 61 and shaft 50, and another seal 66 is arranged between cover plate 65 and shaft 50. Seals 64 and 66 help keep dirt from entering mount 61.

Shaft 50 moves a small amount vertically from thermal expansion and contraction; and inner bearing race 63, while rotating with shaft 50, also moves axially with shaft 50 during thermal elongation. Outer bearing race 69 has a sliding fit within housing 61 that allows vertical movement of outer race 69, even at elevated temperatures. An array of compression springs 68 arranged within mount 61 presses downward on outer race 69 to resist upward movement and prevent rotation of outer race 69. Six compression springs equally spaced apart in a ring around shaft 50 are adequate for this purpose, and other spring arrangements can also be used.

When shaft 50 elongates from thermal expansion and ball bearing 62 rises with shaft 50, outer race 69 compresses springs 68 and rises along with inner race 63 to keep ball bearing 62 in working alignment. When shaft 50 later cools and contracts, lowering ball bearing 62, springs 68 extend somewhat and push outer race 69 downward in alignment with inner race 63. A reasonably light pressure from springs 68 is adequate to prevent outer race 69 from rotating and keep outer race 69 in vertical alignment with inner race 63.

A fan 55 fixed to shaft 50 below bearing 60 directs cooling air over bearing 60 to remove heat from ball bearing 62. Fan 55 works in an opposite direction from fan 40.

Figure 4:
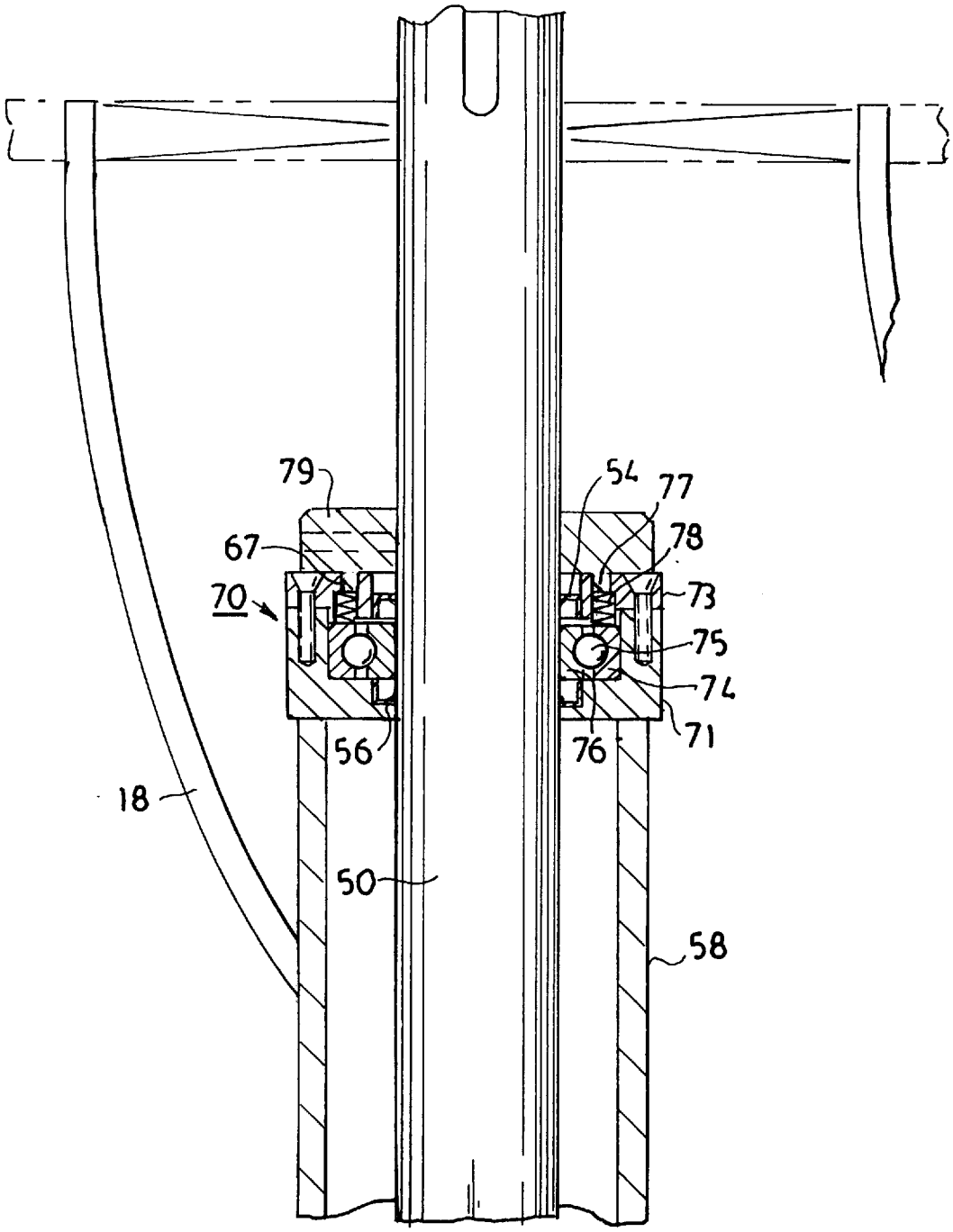
FIG. 4 is an enlarged, partially schematic and partially cut-away view of a bearing arranged in a discharge chute of the pulverizer of FIG. 1.

The plate 59 that supports bearing 60 also supports a pipe 58 that extends upward around shaft 50 into discharge passageway 18. At the top of pipe 58 is a bearing assembly 70 holding another ball bearing 75 for supporting shaft 50, as shown in FIG. 4. A lower shaft seal 56 is arranged between a mount housing 71 and shaft 50, and an upper shaft seal 54 is arranged between a mount cover plate 73 and shaft 50. An array of compression springs 78 retained in cover plate 73 presses down against an outer race 74 of ball bearing 75. As previously described for bearing 60, springs 78 allow outer bearing race 74 to rise with inner bearing race 76 when shaft 50 elongates thermally. This is possible because outer race 74 has a sliding fit within mount housing 71 against the resistance of springs 78.

The arrangement of bearing 75 and bearing mount 71 within discharge passageway 18 subjects bearing 75 to the risk of pulverized material in chute 18 entering housing 71. To reduce this risk, plate 79 is fixed on shaft 50 above cover plate 73 for mount 71. Plate 79 spins with shaft 50 and thereby throws pulverized material radially outward to divert such material away from bearing housing 71. This helps keep ball bearing 75 clean.

Plate 79, being fixed to shaft 50, rises with shaft 50 when thermal elongation occurs. Rising of plate 79 opens a gap between the underside of plate 79 and the top of housing cover 73. To inhibit entry of pulverized material into such a gap, plate 79 has a ring 77 extending downward into a corresponding groove 67 formed in cover plate 73. Ring 77 and groove 67 are concentric with shaft 50 so that ring 77 spins within groove 67 and provides a material barrier across a gap between cover plate 73 and the underside of plate 79. These measures, in conjunction with shaft seals 71 and 72, assure that bearing 75 remains clean. Many different configurations of rings and grooves can be used for such a purpose.

Figure 5:
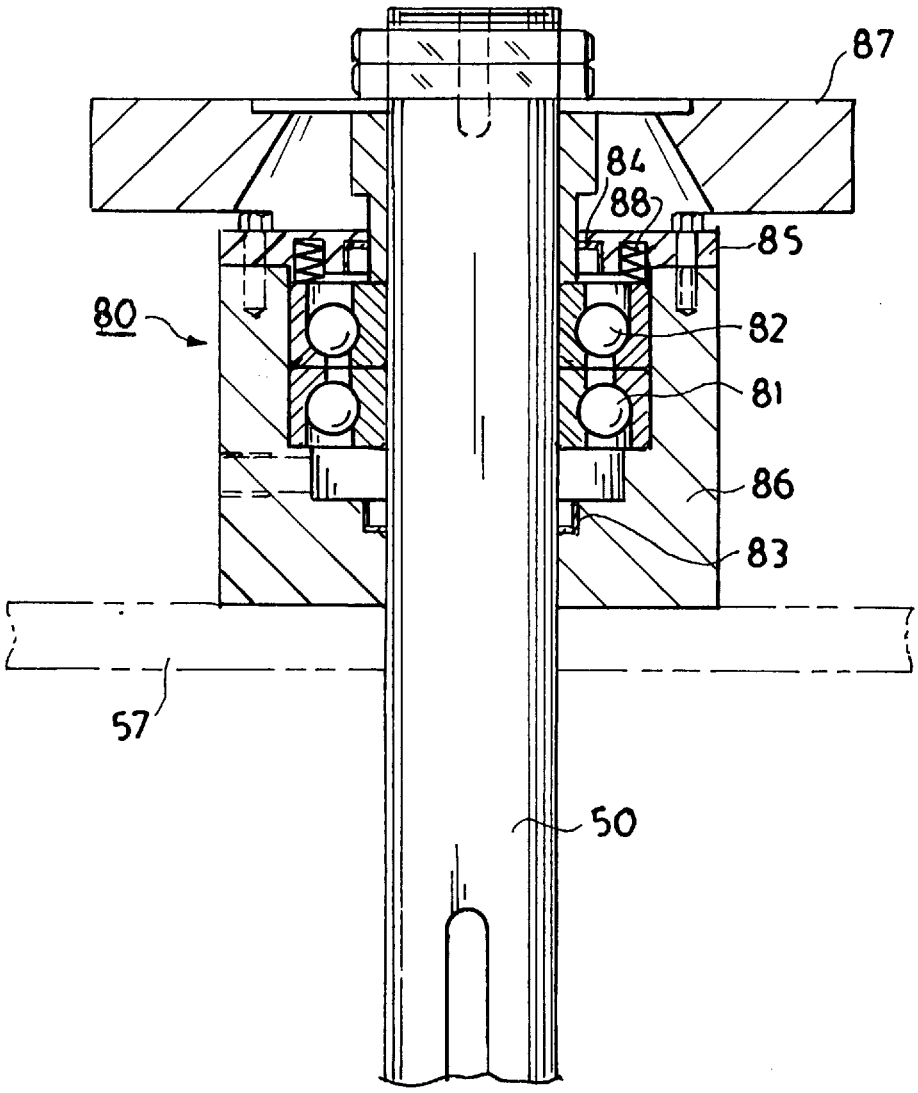
FIG. 5 is an enlarged, partially schematic and partially cut-away view of a bearing arranged above a processing chamber of the pulverizer of FIG. 1.
Figure 6:
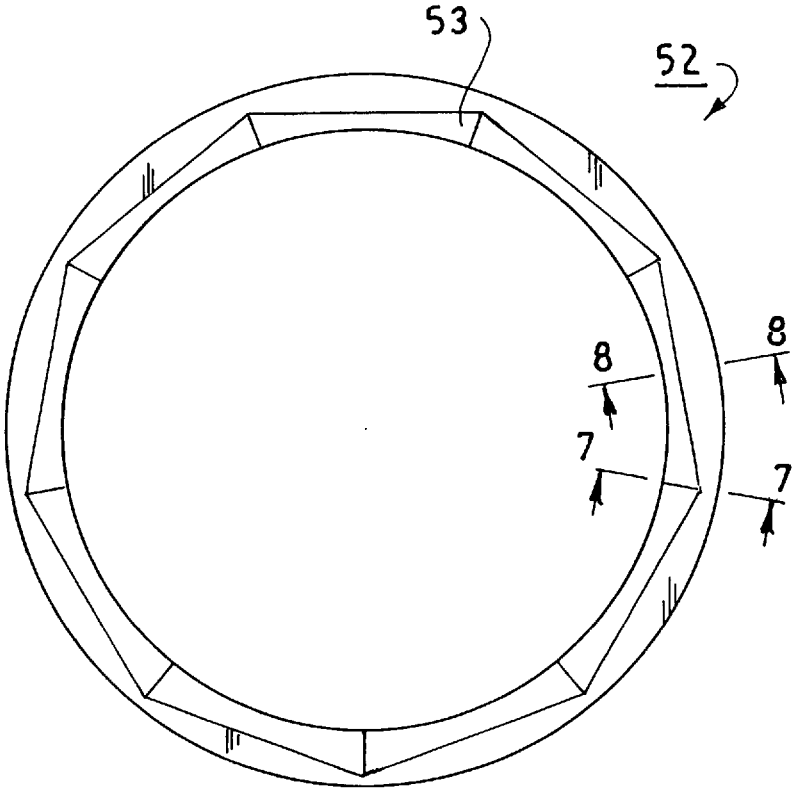
FIG. 6 is a plan view of a preferred embodiment of a top ring for the pulverizer of FIG. 1.

An upper bearing assembly 80 is arranged on a support plate 57 above processing chamber 12 at an upper region of shaft 50, as best shown in FIG. 5. Mount housing 86 of assembly 80 contains a pair of ball bearings 81 and 82, each having a sliding vertical fit within housing 86. An array of compression springs 88 presses downward on the outer race of bearing 82 so that both bearings 81 and 82 can rise with thermal elongation of shaft 50 against the pressure of springs 88. Shaft seals 83 and 84 are arranged respectively in mount housing 86 and in housing cover plate 85. A fan 87 arranged above cover plate 85 directs cooling air over housing 86 for cooling bearings 81 and 82.

The bearing assemblies 60, 70, and 80, arranged above fixed lower bearing 30, all have housing and spring arrangements that allow outer bearing races to rise with thermal elongation of shaft 50. This ensures that all bearings run in alignment and give proper support to shaft 50 under operating conditions. Without such provisions for axial movement of bearings with shaft 50, bearings are destroyed as heat is generated from the work done in processing chamber 12. Many different spring arrangements and configurations of bearings and mount housings are possible, providing the bearings are given freedom of vertical movement.

Figure 7:
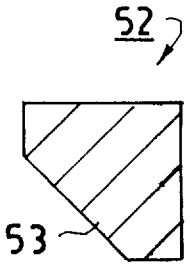
FIG. 7 is a cross-sectional view of the ring of FIG. 6, taken along the line 7—7 thereof.
Figure 8:
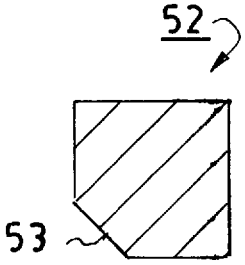
FIG. 8 is a cross-sectional view of the ring of FIG. 6, taken along the line 8—8 thereof.

Within processing chamber 12, I have improved the throughflow of material being pulverized and have enhanced the aggressiveness of the pulverizing action by several improvements. At an upper region of processing chamber 12, I have arranged a ring 52 that has a multi-sided inside surface 53 that is beveled to face downward toward uppermost impeller 15, as best shown in FIGS. 68. Downwardly beveled faces 53 are wider at corners where faces meet, as shown in FIG. 7, and are narrower in central face regions, as shown in FIG. 8. Ring 52 directs material downward into contact with vanes 16 on uppermost impeller 15 so that any material bouncing upward into contact with ring 52 is deflected back downward to encounter pulverizing force.

Figure 9:
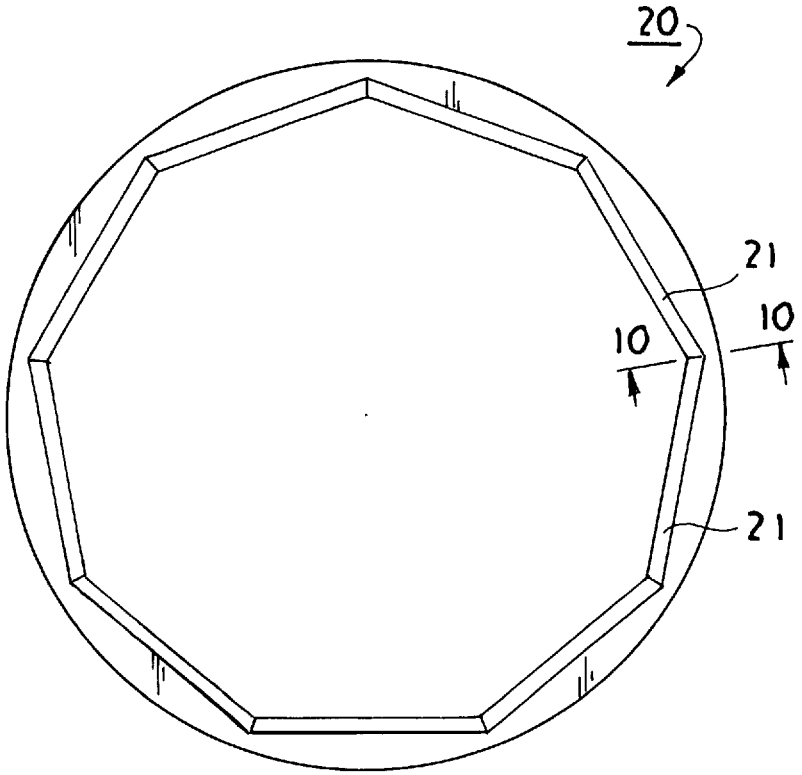
FIG. 9 is a partially schematic plan view of a preferred embodiment of an impact ring of the pulverizer of FIG. 1.
Figure 10:
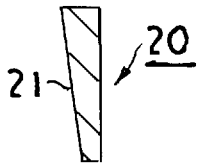
FIG. 10 is a cross section of the ring of FIG. 9, taken along the line 10—10 thereof.
Figure 11:
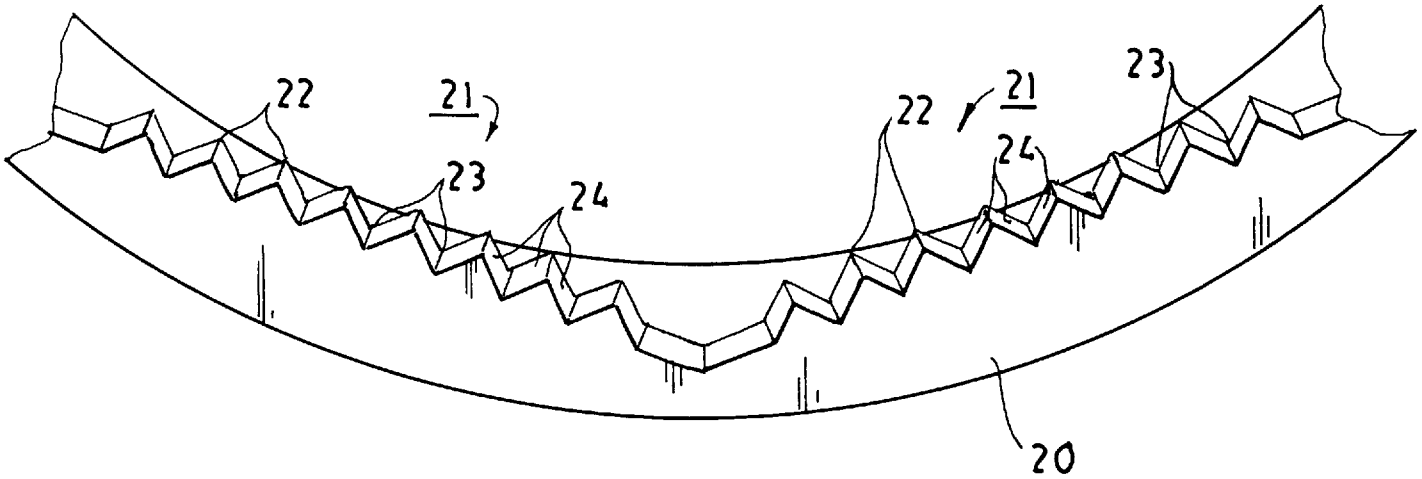
FIG. 11 is an enlarged fragment of the ring of FIG. 9 showing a preferred ridged and grooved inner surface.

Rings 20 that surround impellers 15 are also improved, as shown in FIGS. 9-11. Rings 20 can have different numbers of inward facing surfaces 21, and these are preferably inclined inward from bottom to top, as shown in FIG. 10. A 10° inclination for ring surfaces 21 is preferred, but other angles of inclination may also work. The inward slope of surfaces 21 makes their upper regions extend further into processing chamber 12 than their lower regions, which tends to deflect material downward into impellers 15 and vanes 16. The inward inclination of surfaces 21 of a succession of rings 20 enhances the throughflow of material being pulverized and also helps direct pulverizable material into contact with vanes 16 of impellers 15.

Inward facing surfaces 21 of rings 20 are also preferably provided with ridges and grooves, as shown in FIG. 11.

Preferably evenly spaced ridges 22 separated by grooves 23 provide a jagged or zigzag contour for surfaces 21 for scattering material impacting on surfaces 21. Sloping sides 24 of ridges 23 deflect impacting material in various directions, depending on angle of incidence. Sloping ridge sides 24 can also lead to double impacts of material glancing off of one ridge side and impacting against another. The result is to deflect or rebound material in different directions, adding randomness to the pulverizing process and making pulverization more aggressive.

I claim:

1. In a solid material pulverizer having a plurality of impellers spaced axially along a single shaft supported by a plurality of ball bearings so that the shaft extends through a plurality of chambers having multi-sided walls surrounding and confronting the impellers to form a succession of stages through which solid material flows as the material is reduced to finer particles, the improvement comprising:

a. bearings above a bottom bearing being retained in fixed mounts that allow vertical bearing movement as the shaft elongates from thermal expansion;

b. each of the mounts having a spring system arranged for pressing resiliently downward against outer races of the bearings; and c. the outer races of the bearings having sliding fits within the mounts so that the outer races of the bearings can follow movement of inner races of the bearings, which move with thermal changes in shaft length.

2. The improvement of claim 1 wherein the mounts have cover plates that confine the bearings within the mounts and compress the spring system against the outer bearing races.

3. The improvement of claim 1 wherein the mounts include shaft seals arranged above and below the bearings.

4. The improvement of claim 1 wherein fans are arranged on the shaft adjacent the bearings for directing cooling air over the bearings.

5. The improvement of claim 1 wherein the walls surrounding the impellers are inclined inward from bottom to top.

6. The improvement of claim 5 wherein the walls surrounding the impellers have ridged and grooved surfaces.

7. The improvement of claim 1 wherein a bearing arranged in a material outflow stream from the pulverizer has a superposed plate fixed to the shaft for rotationally diverting material away from the bearing.

8. The improvement of claim 7 wherein a circular ring and mating groove concentric with the shaft are arranged to form a material barrier between the superposed plate and the bearing mount.

9. The improvement of claim 1 wherein the spring system comprises an annular array of compression coil springs.

10. A ball bearing support system combined with a vertically oriented shaft that rotates within a solid material pulverizer, the system comprising:

a. a fixed housing sealed to the shaft and arranged to enclose the ball bearing in a region outside of a material processing chamber of the pulverizer;

b. the interior of the fixed housing being configured to allow room for the ball bearing to move axially within the housing as a length of the shaft varies thermally;

c. an inner race of the bearing being fitted to the shaft, and an outer race of the bearing having a sliding fit within the interior of the housing; and d. a spring arrangement within the housing resiliently pressing downward on the outer race of the bearing to prevent rotation of the outer race and allow vertical movement of the outer race in response to movement of the inner race with the changing length of the shaft.

11. The system of claim 10 including a fan arranged on the shaft adjacent the housing for directing cooling air over the housing.

12. The system of claim 10 including a plate fixed to the shaft for rotation above the housing to divert material from the housing.

13. The system of claim 12 wherein a mating ring and groove arranged between the plate and the housing concentric with the shaft allow axial movement of the plate relative to the housing and afford a barrier against entry of material into the housing.

14. The system of claim 10 wherein the housing is arranged above a fixed lower end of the shaft.

15. The system of claim 10 wherein the housing is arranged both above and below the chamber.

16. The system of claim 10 wherein the spring arrangement comprises an annular array of compression springs.

17. A solid material pulverizer comprising:

a. a vertical shaft having a fixed ball bearing at a lower end region and a plurality of vertically movable ball bearings spaced along the shaft above the fixed bearing;

b. each of the bearings above the fixed bearing being resiliently held respectively in a fixed mount that allows an outer race of the bearing to rise vertically against spring pressure as the shaft lengthens from thermal expansion;

c. impellers being fixed to the shaft between the bearings for hurling solid material against rings arranged around the impellers; and d. each ring having a multi-sided interior with ridges and grooves confronting the impeller and angled inward from bottom to top of the ring.

18. The pulverizer of claim 17 including a top ring arranged above the periphery of an uppermost one of the impellers, the top ring having a downwardly and outwardly beveled surface facing obliquely downward toward the uppermost impeller.

19. The pulverizer of claim 17 including a drive belt pulley arranged on the shaft between the fixed bearing and a bearing above the fixed bearing.

20. The pulverizer of claim 17 wherein a bearing above the fixed bearing is arranged in a material discharge stream from the pulverizer and includes a plate fixed to the shaft for rotation above the mount for the bearing in the discharge stream.

21. The pulverizer of claim 17 wherein the mounts for the bearings above the fixed bearing include housings with interiors allowing the bearings to move vertically and spring arrangements pressing downwardly on outer races of the bearings.

22. The pulverizer of claim 21 wherein the spring arrangements are annular arrays of compression springs.

* * * * *